United States Patent [19]

Hull et al.

[11] Patent Number: 5,055,645

[45] Date of Patent: Oct. 8, 1991

[54] LIGHT SWITCH EXTENSION

[76] Inventors: Harold L. Hull, 401 Canyon Way #43, Sparks, Nev. 89434; Clive R. Belvoir, 2800 S. Curry St., Carson City, Nev. 89701; Erle B. Shucker, 890 Jamaica #3, Reno, Nev. 89502

[21] Appl. No.: 496,591

[22] Filed: Mar. 21, 1990

[51] Int. Cl.[5] ..... H01H 3/02

[52] U.S. Cl. ..... 200/331

[58] Field of Search ..... 200/331, 43.01

[56] References Cited

U.S. PATENT DOCUMENTS

| | | | |
|---|---|---|---|
| D. 252,552 | 8/1979 | Stoff | 200/331 X |
| D. 274,972 | 8/1984 | Mann | D8/14 |
| 2,668,456 | 5/1951 | Meistrell | 74/503 |
| 2,719,898 | 4/1952 | Allen | 200/331 |
| 2,726,303 | 4/1953 | Bendsen | 200/331 |
| 3,004,128 | 10/1961 | Mikolajeski | 200/331 |
| 3,722,319 | 3/1973 | Reznik | 74/544 |
| 3,839,615 | 10/1974 | Bradford | 200/331 |
| 4,221,946 | 9/1980 | Halstrum | 200/331 |
| 4,295,026 | 10/1981 | Williams | 200/331 |
| 4,590,345 | 5/1986 | Marshall | 200/331 |
| 4,705,924 | 11/1987 | Hevoyan | 200/331 |
| 4,743,724 | 5/1988 | Goodwin | 200/331 |
| 4,771,145 | 9/1988 | Davis | 200/331 |

*Primary Examiner*—Renee S. Luebke

[57] ABSTRACT

A light switch extension which enables, children, short people or handicapped people to turn on and off the light switch. The extension also provides interchangeable, adhesive faces which glow in the dark or molded faces. The handle is rotateable 360 degrees so that when the handle is in its highest position the extension is unattainable to the child leaving the desired amount of use to the option of the parent.

13 Claims, 2 Drawing Sheets fig 1
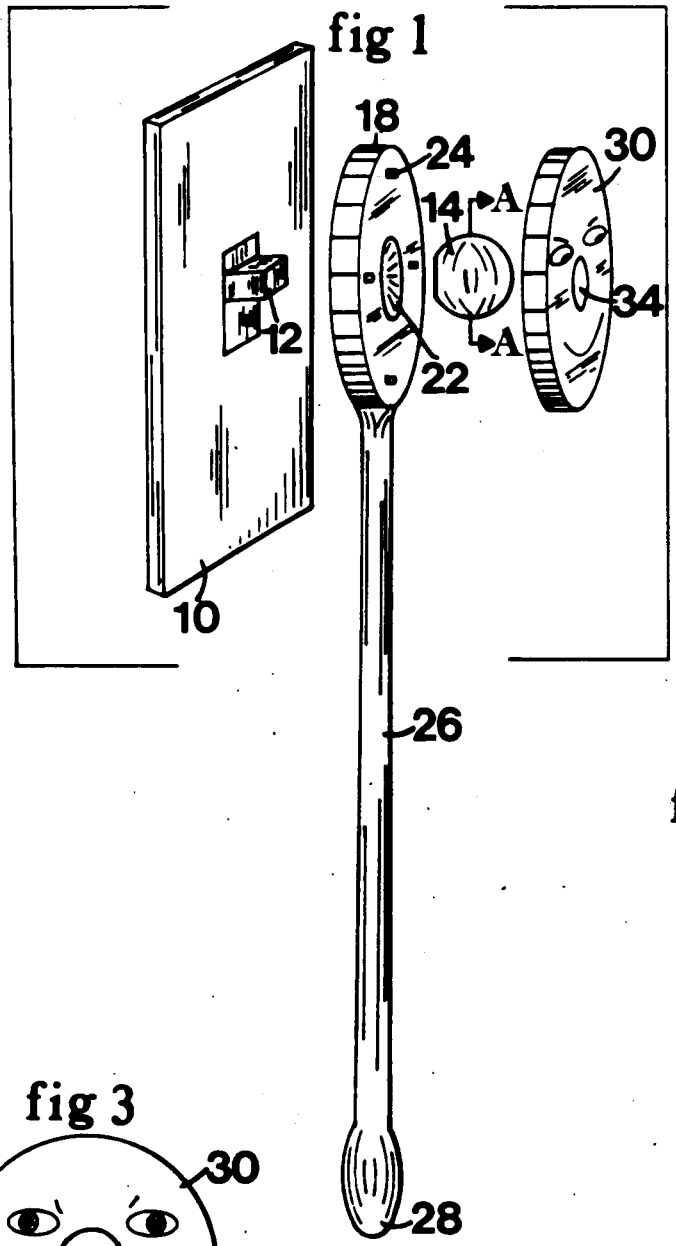
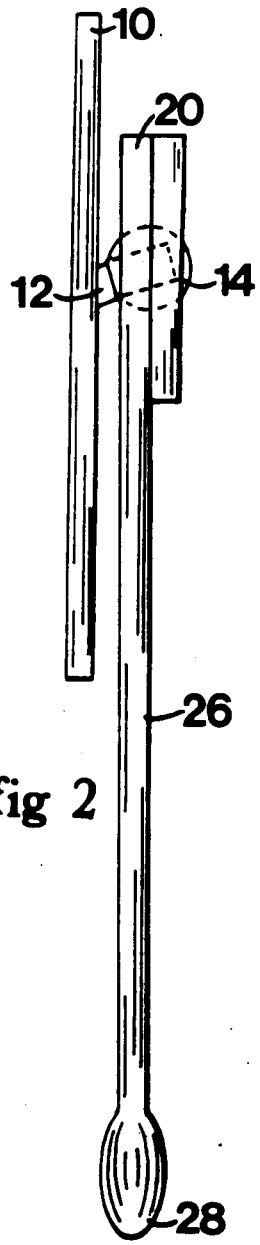
fig 2
fig 3
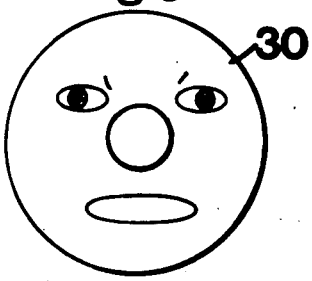
fig 4
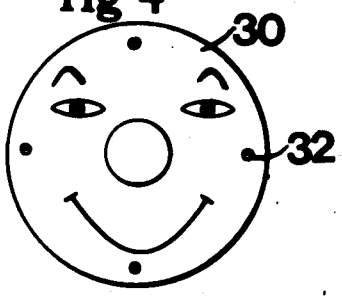
fig 5
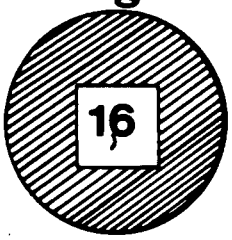

LIGHT SWITCH EXTENSION

FIELD OF THE INVENTION

This invention relates to light switch extensions which when attached to a wall-mounted household toggle switch will enable a child, a short individual or handicapped person to control the on/off light switch by use of the extension and more particularly to light switch extensions that glow in the dark. The handle is rotatable 360 degrees.

BACKGROUND OF THE INVENTION

Many light switch adapters or extensions have been taught such as U.S. Pat. Nos. 4,221,946/3,839,615/2,668,456 and 4,295,026 in which removal of the switch plate or like body is necessitated for installation; this procedure tends to be time consuming and dangerous. U.S. Pat. Nos. 4,705,924/D,274,972/2,726,303/2,719,898/ and 3,722,319 utilize a vertically reciprocable member operated by a control knob or handle similar to the present invention. However the present invention is designed for a further purpose, that is the control member is rotatable 360 degrees. Therefore, the parent can regulate the desired amount of use of the extension. For example if the parent for some reason wishes for the child not to operate the extension the parent would then simply turn the extension in a vertical position above the light switch. Hence it would then be unattainable for the child to reach the extension. When the parent wishes for the child to use the extension they would then simply rotate the extending member into a vertical position below the light switch wherein the extension would again be attainable.

The present invention has a further advantage which is that the handle of the extension is designed with interchangeable, florescent, adhesive faces which enable the child to find the extension in the dark while also making the extension attractive and fun to use.

SUMMARY OF THE INVENTION

It is a primary object of the present invention to provide a light switch extension which has certain elements which may be made to glow in the dark such as the handle, a molded face, or changeable applique faces.

It is a further object to provide a light switch extension which is rotatable 360 degrees allowing the parent to regulate the desired amount of use of the extension.

It is yet another object to provide a light switch extension that can be installed without hindering the light switch functions.

It is still another object to provide a light switch extension designed to assist the handicapped, short people and children to turn on and off the light switch.

It is a further object to provide a light switch extension that is simple, easy and fun to use.

A still further object is to provide a light switch extension that is economical in cost to manufacture.

Other objects and advantages will become obvious when taken into consideration with the following drawings and specifications.

BRIEF DESCRIPTION OF THE DRAWINGS

FIG. 1 is an exploded perspective view of all the parts.

FIG. 2 is a side view of the extension attached to the light switch.

FIG. 3 is a frontal view of a molded face.

FIG. 4 is a frontal view of a molded face showing mounting means being screws.

FIG. 5 is a section taken at A—A and drawn to a larger scale.

DETAILED DESCRIPTION OF THE DRAWINGS

Figure 6:
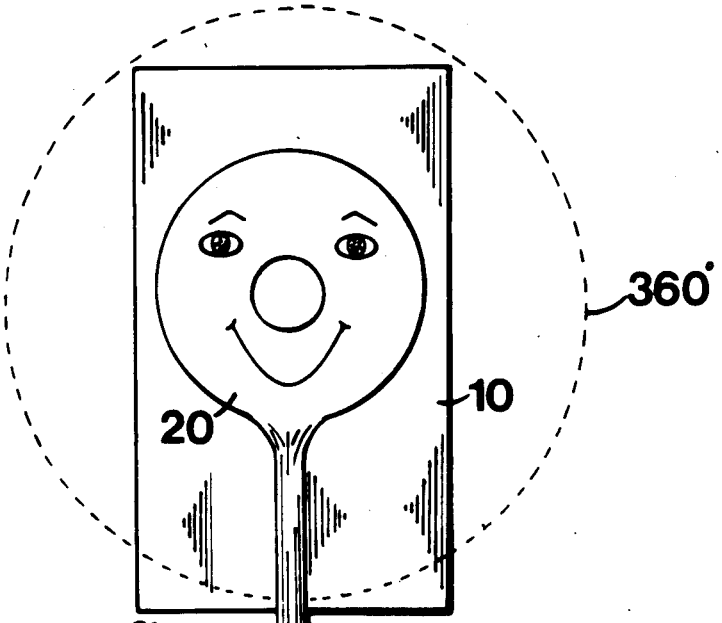
FIG. 6 is a frontal view of the device attached to a wall switch.
Figure 7:
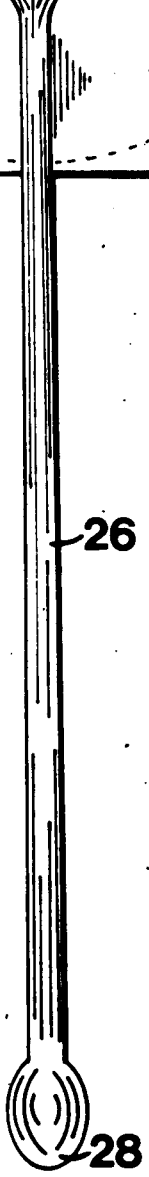
FIG. 7 is a frontal view of a florescent, interchangeable, adhesive face.
Figure 7:
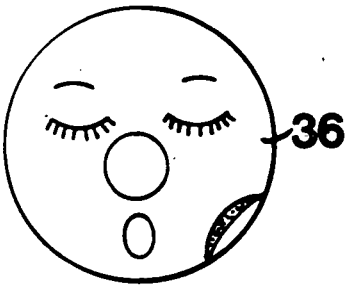
Figure 9:
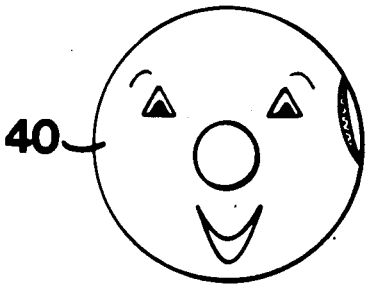
FIG. 9 is a frontal view of a florescent, interchangeable, adhesive face.
Figure 8:
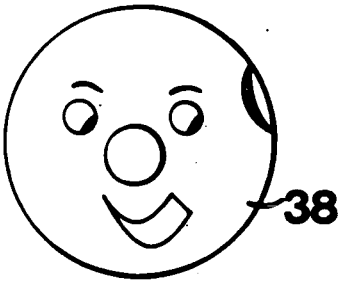
FIG. 8 is a frontal view of a florescent, interchangeable, adhesive face.
Figure 10:
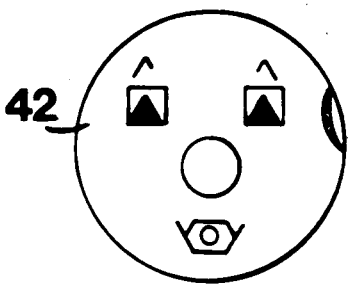
FIG. 10 is a frontal view of a florescent, interchangeable, adhesive face.

Referring now to the drawings in detail wherein like numerals represent like parts, 10 is a light switch plate with 12 being an on/off switch lever with 14 being a ball element which is made of a suitable material such as rubber, plastic, wood etc., and is frictionally engaged, at square slot 16, with on/off switch lever 12. Member 18 comprises a face mounting member 20 which contains a cavity 22 and mounting extrusions 24, handle 26 and knob 28. A face plate 30 is secured to member 18 by extrusions 24 which cooperate with cavities on the back side of face plate 30 (not shown) or is secured by screws 32 shown in FIG. 4. Face plate 30 also contains a cavity 34 which cooperates with ball 14. Member 18 and face plate 30 capture ball 14 in cavities 22 and 34 respectively, allowing members 18 and face plate 30 to be rotatably attached to ball 14.

In a second embodiment, face plate 30 can be molded with its face side flat so that the glow in the dark adhesive faces such as 36, 38, 40, and 42 may be applied.

It will now be seen that we have provided a light switch extension which may be installed simply by engaging the slot in the ball over the on/off switch lever, and the on/off switch lever may now be operated by simply raising or lowering the extension handle as the ball acts as a floating member.

It will also be noted that the extension member is rotatable 360 degrees as the ball is only frictionally engaged by the handle and face plate members which enable the parent to regulate the desired amount of use.

It will now be seen that we have provided a light switch extension which may be provided with parts such as the handle or adhesive faces that glow in the dark.

It will be seen that we have provided a light switch extension that can be installed without hindering the light switch functions.

It will also be seen that we have provided an extension designed for short people, handicapped people or children.

It will be noted that we have provided a light switch extension that is simple, easy and fun to use.

It will also be seen that we have provided a light switch extension that is economical in cost to manufacture because it can be made of plastic by injection molding or made of wood or rubber.

Although the invention has been herein shown and described in what is conceived to be the most practical and preferred embodiments, it is recognized that departures may be made therefrom within the scope of the invention, which is not to be limited to the details disclosed herein but it is to be accorded the full scope of the claims so as to embrace any and all equivalent devices and apparatus.

What we claim is:

1. A light switch extension detachably connected to an on/off lever of a wall light switch, said extension comprising; a ball having a cavity cooperating with the lever, a first member comprising a mounting member and an elongated handle, and a second member; said ball being frictionally engaged with said lever, said mounting member and said second member each having a cavity in a substantially center portion thereof, said ball being captured and substantially surrounded by the cavities of the mounting member and the second member, said first and second member having means to be affixed together.

2. The device of claim 1 in which said ball is made of wood.

3. The device of claim 1 in which said ball is made of rubber.

4. The device of claim 1 in which said ball is made of plastic.

5. The device of claim 1 in which said mounting and said second members are frictionally engaged with said ball and rotatable through 360 degrees.

6. The device of claim 1 in which said handle of said first member has a knob on an end.

7. The device of claim 1 in which said second member has a molded face on a first side.

8. The device of claim 1 in which said means to affix said first and said second members together comprises two protrusions and two cavities.

9. The device of claim 1 in which said means to affix said first and said second members together comprises two screws.

10. The device of claim 1 in which said means to affix said first and said second members is bonding.

11. The device of claim 1 in which said second member is flat on a first side to accommodate changeable applique faces.

12. The device of claim 11 in which said changeable applique faces are attached by adhesive.

13. The device of claim 11 in which said handle or said changeable applique faces glow in the dark.

* * * * *